US010871076B2

(12) United States Patent
Jang

(10) Patent No.: US 10,871,076 B2
(45) Date of Patent: Dec. 22, 2020

(54) ROTATING UNIT AND STEAM TURBINE INCLUDING THE SAME

(71) Applicant: DOOSAN HEAVY INDUSTRIES & CONSTRUCTION CO., LTD., Changwon-si (KR)

(72) Inventor: Seok Jin Jang, Gimhae-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 302 days.

(21) Appl. No.: 15/928,120

(22) Filed: Mar. 22, 2018

(65) Prior Publication Data

US 2018/0283188 A1 Oct. 4, 2018

(30) Foreign Application Priority Data

Mar. 31, 2017 (KR) ..... 10-2017-0042044

(51) Int. Cl.
*F01D 5/30* (2006.01)
*F01D 5/32* (2006.01)
(Continued)

(52) U.S. Cl.
CPC ..... *F01D 5/3038* (2013.01); *F01D 5/26* (2013.01); *F01D 5/3061* (2013.01); *F01D 5/32* (2013.01);
(Continued)

(58) Field of Classification Search
CPC ..... F01D 5/30; F01D 5/303; F01D 5/3038; F01D 5/32; F01D 5/3023; F01D 5/3046
See application file for complete search history.

(56) References Cited

U.S. PATENT DOCUMENTS 2,809,801 A 10/1957 Curry
5,100,292 A 3/1992 Matula et al.
(Continued)

FOREIGN PATENT DOCUMENTS

EP 1959098 A1 8/2008
EP 2532835 A2 12/2012
(Continued)

OTHER PUBLICATIONS

The Extended European Search Report dated Jul. 9, 2018 in corresponding European Patent Application No. 18164952.6.
(Continued)

*Primary Examiner* — Kayla Mccaffrey
(74) *Attorney, Agent, or Firm* — Invenstone Patent, LLC

(57) ABSTRACT

A rotating unit of a steam turbine includes a rotor; a bucket coupled to the rotor to convert fluid energy into mechanical work, the coupled bucket being pre-twisted at a predetermined angle, the bucket having a base surface facing a point of coupling between the rotor and the bucket; and bucket support means, provided at the point of coupling between the rotor and the bucket, for supporting a twisted state of the bucket based on the coupling between the rotor and the bucket, thereby enabling the twisting of the bucket to be maintained during operation. In a steam turbine including the rotating unit, it is possible to reduce vibration occurring during operation and to increase the contact force between a cover formed at the blade tip of the bucket and a cover of another bucket to prevent a leakage of steam between adjacent covers.

18 Claims, 7 Drawing Sheets

(51) Int. Cl.
*F01D 5/26* (2006.01)
*F01D 5/22* (2006.01)

(52) U.S. Cl.
CPC ..... *F01D 5/225* (2013.01); *F05D 2220/31* (2013.01); *F05D 2230/232* (2013.01); *F05D 2240/80* (2013.01)

(56) References Cited

U.S. PATENT DOCUMENTS

| | | | | |
|---|---|---|---|---|
| 5,509,784 | A * | 4/1996 | Caruso | F01D 5/225 416/190 |
| 8,257,046 | B2 * | 9/2012 | Saito | F01D 5/16 415/115 |
| 8,651,820 | B2 * | 2/2014 | Krikunov | F01D 5/3007 416/215 |
| 10,072,508 | B2 * | 9/2018 | Beaujard | F01D 5/02 |
| 2006/0216152 | A1 * | 9/2006 | Golinkin | F01D 5/3007 416/220 R |
| 2009/0220345 | A1 | 9/2009 | Kruetzfeldt et al. | |

FOREIGN PATENT DOCUMENTS

| | | | |
|---|---|---|---|
| JP | 63-168201 | U1 | 11/1988 |
| JP | 4673732 | B2 | 4/2011 |
| JP | 2011074806 | A | 4/2011 |
| JP | 2014214605 | A | 11/2014 |
| JP | 2016070095 | A | 5/2016 |

OTHER PUBLICATIONS

An European Search Report dated Aug. 12, 2019 in connection with European Patent Application No. 18164952.6 which corresponds to the above-referenced U.S. application.

* cited by examiner

[FIG. 1]
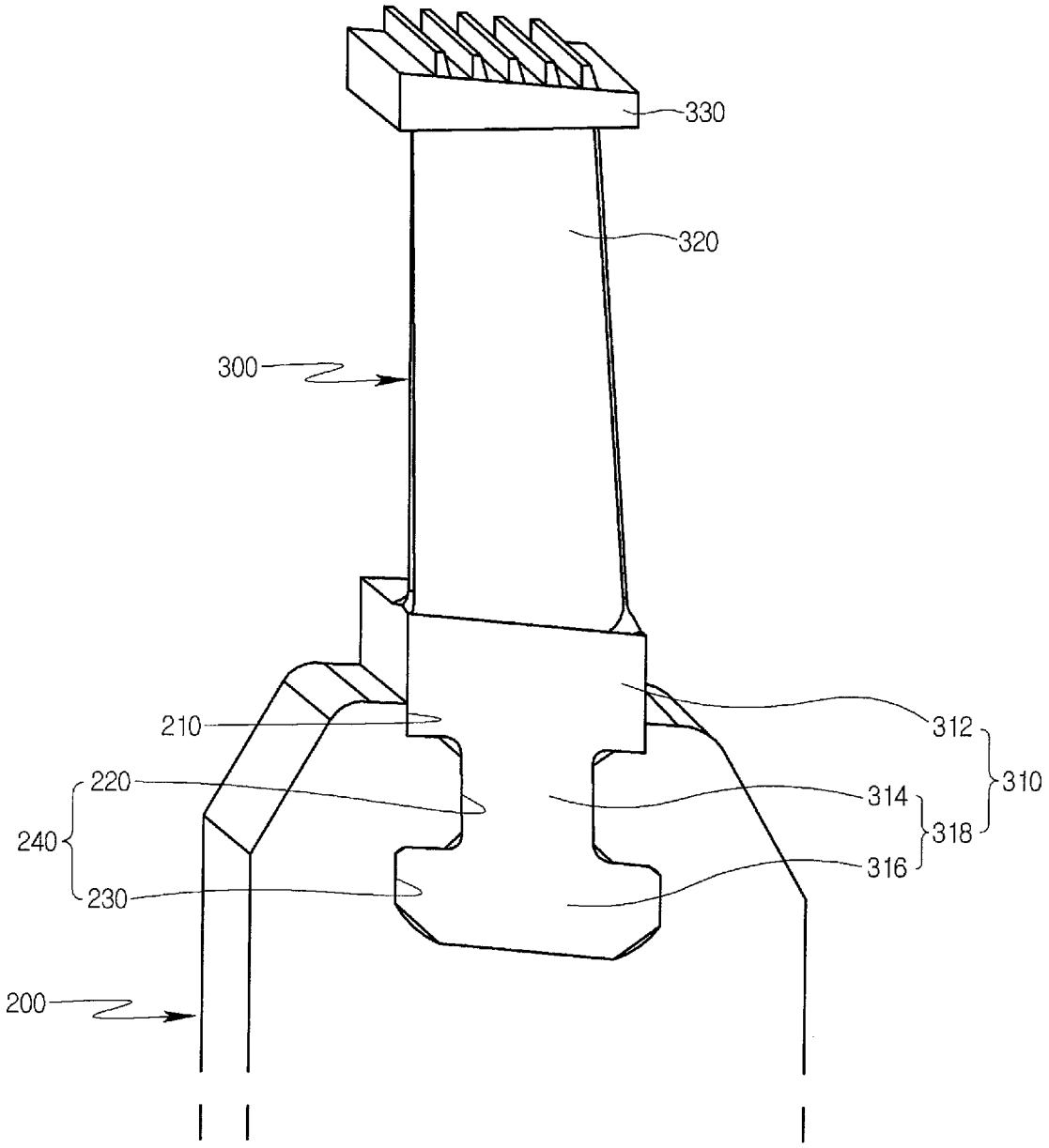
Related Art

[FIG. 2]
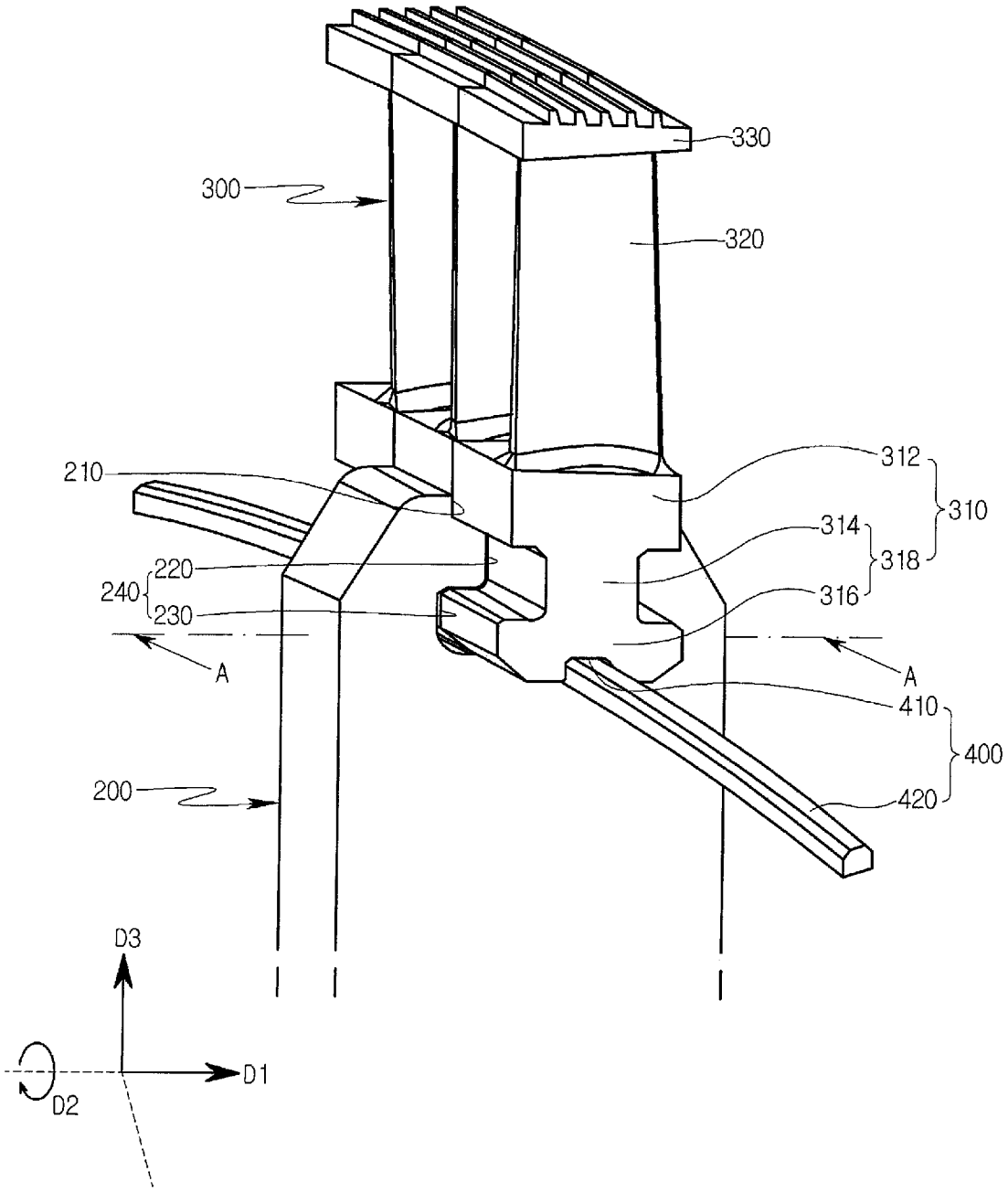

[FIG. 3]
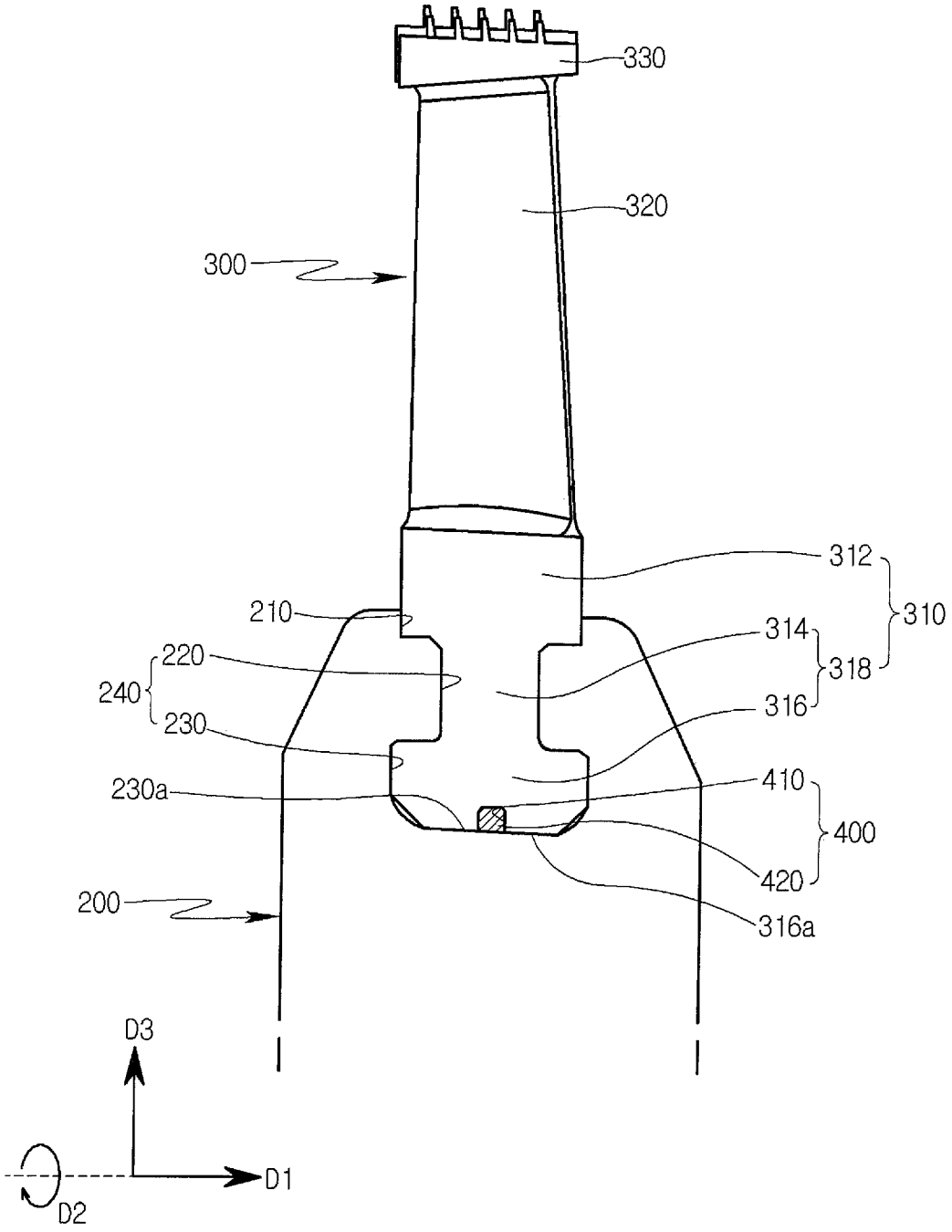

[FIG. 4]
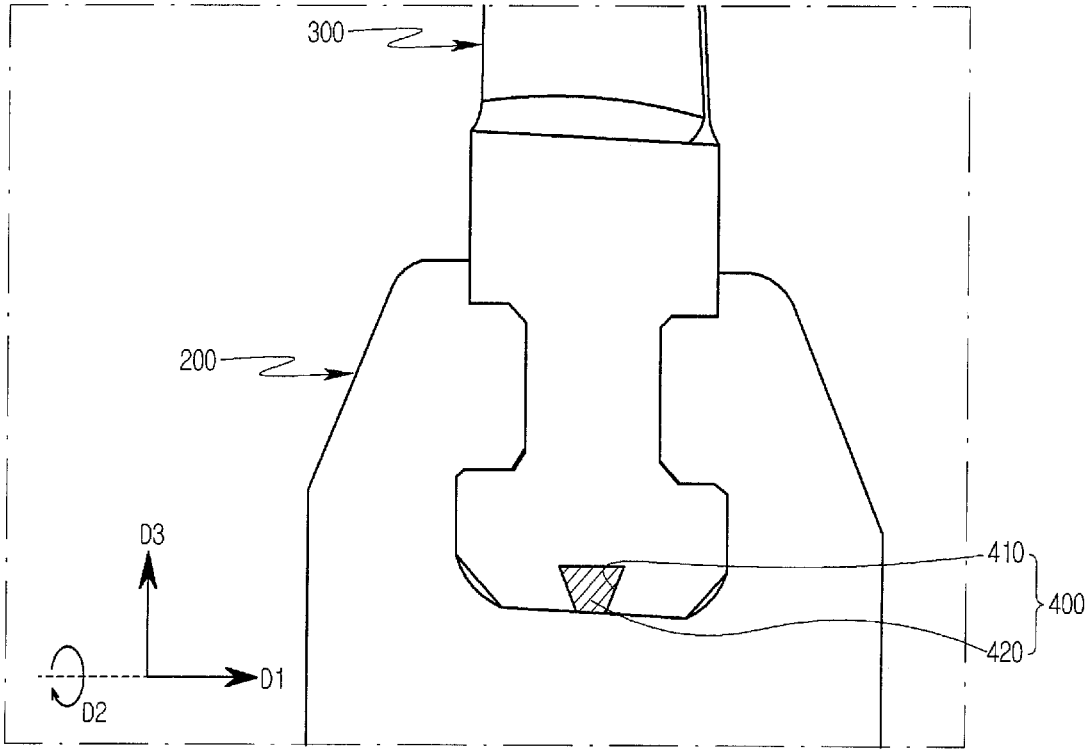

[FIG. 5]
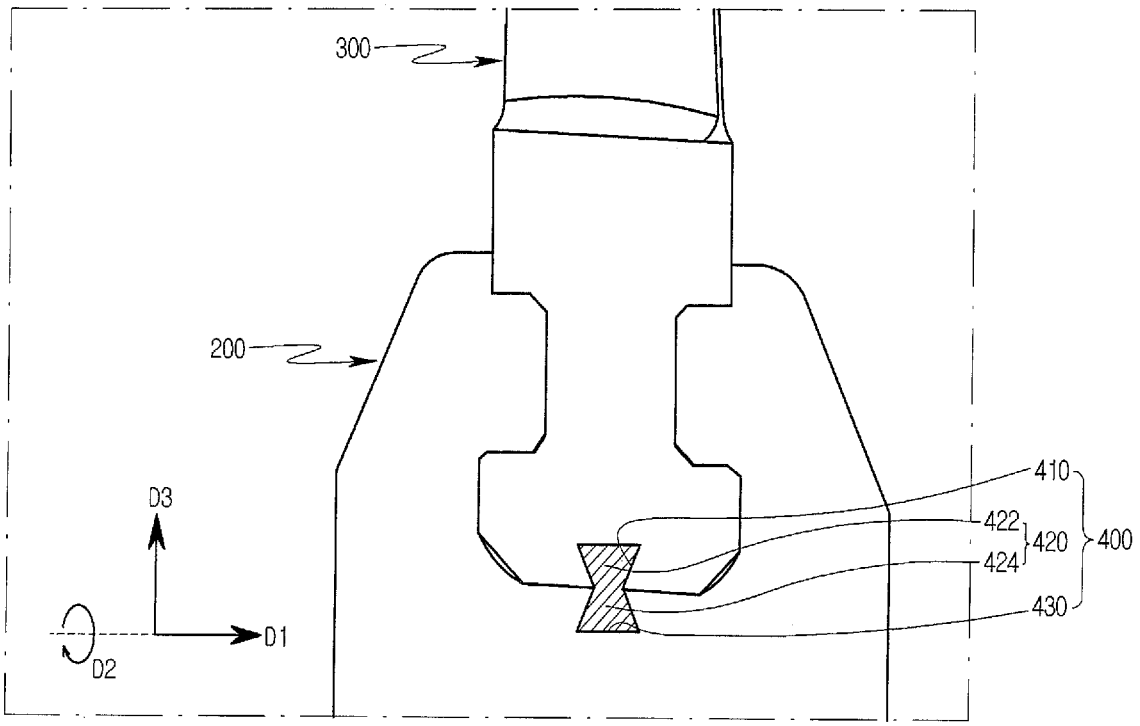

[FIG. 6]
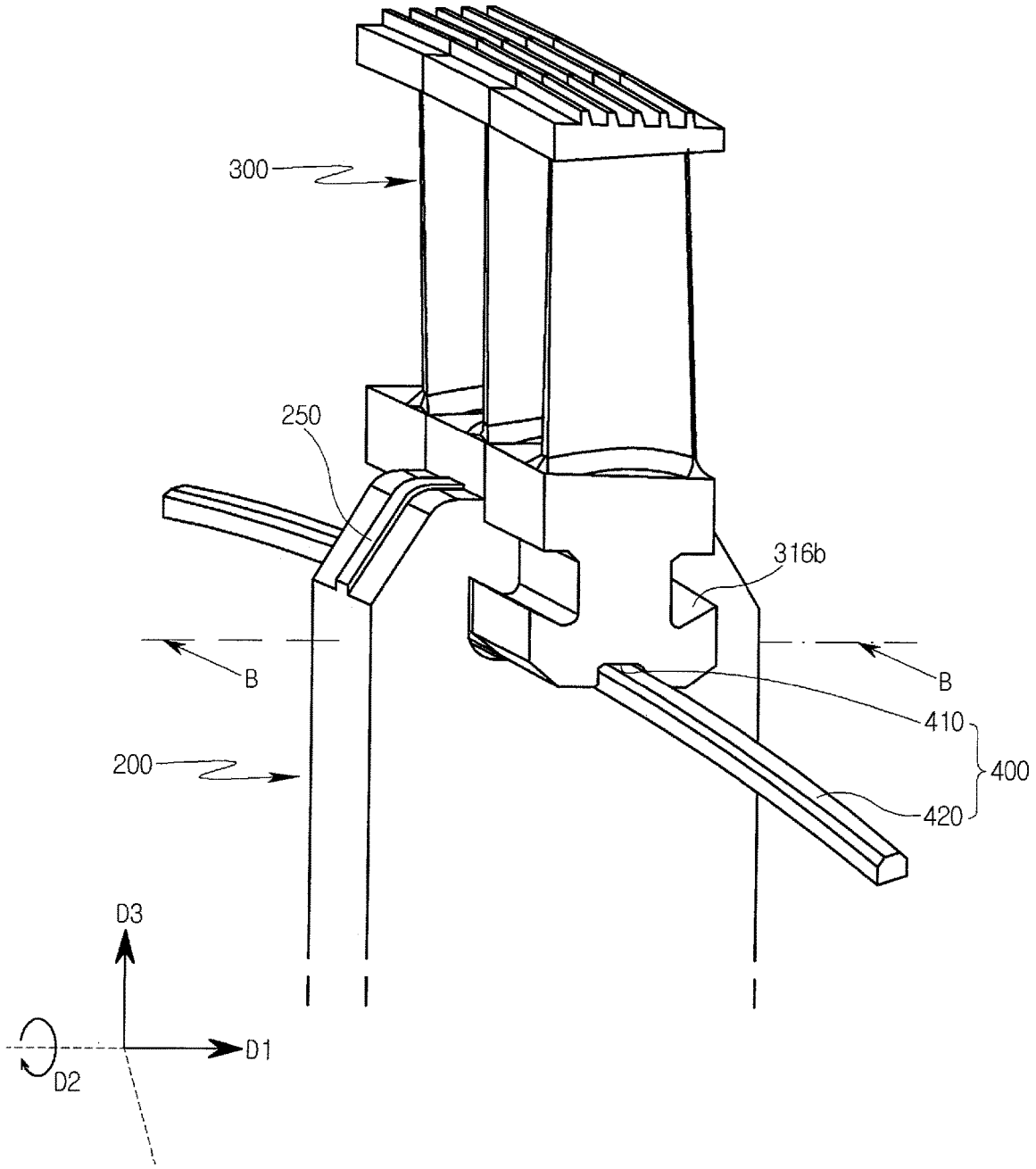

[FIG. 7]
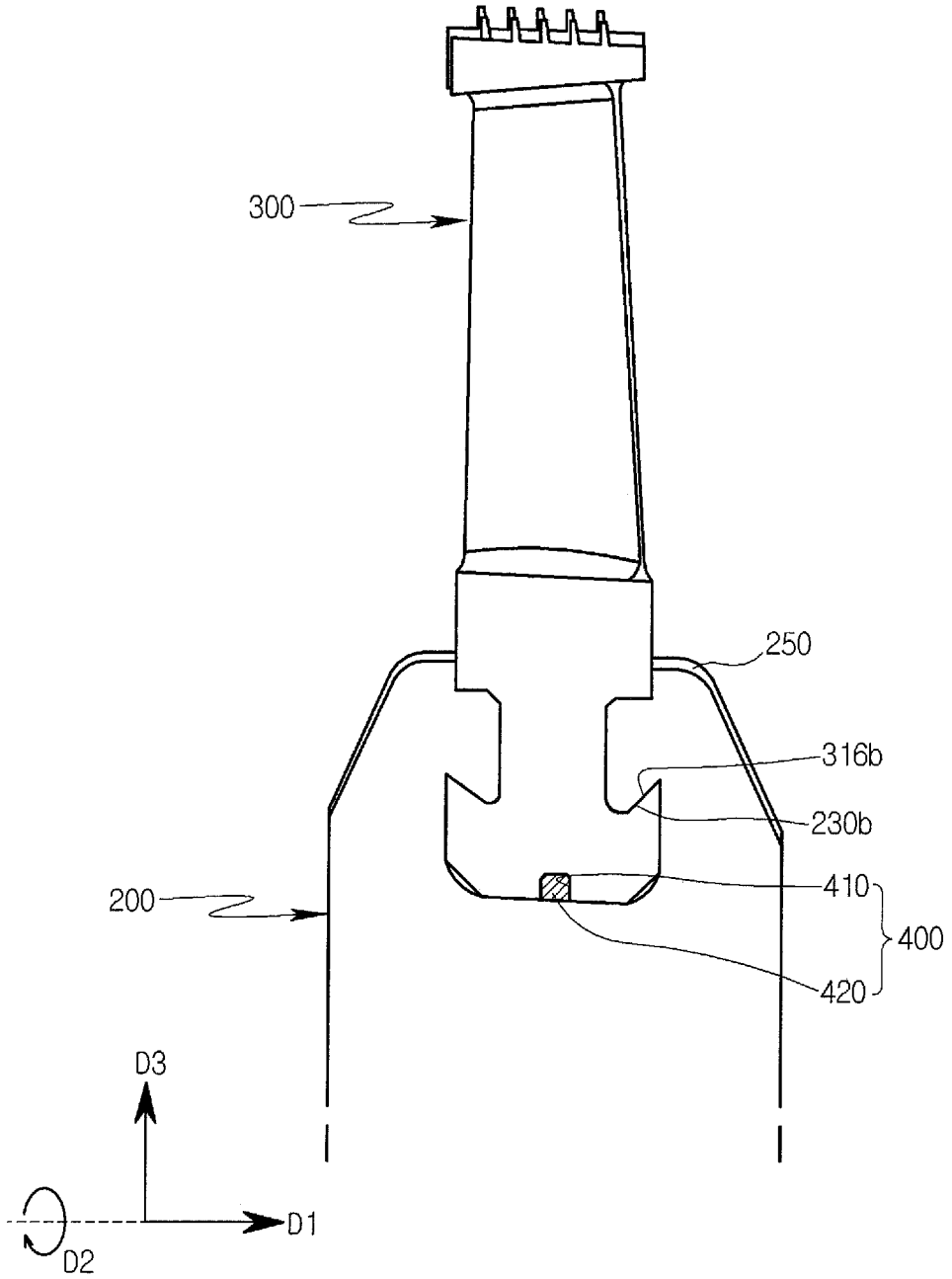

ROTATING UNIT AND STEAM TURBINE INCLUDING THE SAME

CROSS-REFERENCE TO RELATED APPLICATIONS

This application claims priority to Korean Patent Application No(s). 10-2017-0042044, filed on Mar. 31, 2017, the disclosure(s) of which is incorporated herein by reference in its(their) entirety.

BACKGROUND OF THE INVENTION

Field of the Invention

Exemplary embodiments of the present invention relate to a rotating unit and a steam turbine including the same, and more particularly, to a rotating unit in which a pre-twisted type continuous coupled bucket (CCB) structure is applied for a turbine wheel, and to a steam turbine including the same. In the rotating unit of the present invention, a bucket is inserted into a rotor in the rotational direction and is then coupled to the rotor in a state in which the bucket is twisted at a predetermined angle.

Description of the Related Art

In general, a turbine is a machine that converts the energy of a fluid such as water, gas, or steam into mechanical work, and a turbomachine, in which many vanes or blades are mounted to the circumference of a rotating unit and steam or gas is injected into the blades to rotate the rotating unit at high speed, is typically referred to as the turbine. Examples of the turbine include a water turbine using the energy of falling water, a steam turbine using the energy of steam, a gas turbine using the energy of high-temperature and high-pressure gas, and an air turbine using the energy of high-pressure compressed air.

Among these, the steam turbine rotates a rotating unit by injecting steam from a nozzle toward a plurality of blades to convert the energy of the steam into mechanical work. Specifically, the steam turbine includes a casing that forms the turbine's external appearance and frame, a rotating unit that is rotatably installed in the casing, and a nozzle that injects steam into the rotating unit.

FIG. 1 illustrates a portion of a rotating unit in a contemporary steam turbine.

Referring to FIG. 1, a rotating unit includes a rotatable rotor 200, and a bucket 300 coupled to the rotor 200 to convert the energy of steam injected from a nozzle (not shown) into mechanical work.

The bucket 300 is twisted at a predetermined angle and is coupled to the rotor 200 to suppress vibration and prevent a leakage of steam, as disclosed in Japanese Patent Application Publication No. 2015-72017.

In more detail, the bucket 300 consists of a plurality of buckets, and each of the buckets includes a root 310 coupled to the rotor 200, a blade 320 protruding in the radial direction of the rotor 200 from the root 310, and a cover 330 protruding in the rotational direction of the rotor 200 from the blade tip of the blade 320. The root 310 of one of the plurality of buckets 300 is supported by the rotor 200, and the cover 330 of the bucket 300 is pressure-welded to a cover 330 formed on a bucket 300 adjacent to the bucket 300, so that the blade 320 of each bucket 300 is twisted at a predetermined angle. Here, the cover 330 of the bucket 300 overlaps the cover 330 of an adjacent bucket 300, and the adjacent covers 330 are pressure-welded to each other while the bucket 300 is twisted when it is coupled to the rotor 200.

However, the related art rotating unit and the steam turbine including the same is problematic in that the twisting of the bucket 300 is released (untwisted) since the bucket 300 is not supported by the rotor 200 during operation.

Specifically, the root 310 includes a platform 312 formed at the blade root of the blade 320, and a dovetail protrusion 318 located opposite the blade 320 with respect to the platform 312. The dovetail protrusion 318 includes a first dovetail protrusion 314 that extends toward the center of rotation of the rotor 200 from the platform 312, and a second dovetail protrusion 316 that extends in the axial direction of the rotor 200 from the first dovetail protrusion 314. Here, the dovetail protrusion 318 has a "T" shape for a reduction in cost of manufacture through shape simplification, and the "T" shape of the dovetail protrusion 318 is generally configured by extending toward a center of rotation of the rotor 200 from the platform 312.

Meanwhile, the rotor 200 coupled to the root 310 includes a seating groove 210 in which the platform 312 is seated, and a dovetail groove 240 that has a first dovetail groove 220 engaged with the first dovetail protrusion 314 and a second dovetail groove 230 engaged with the second dovetail protrusion 316. In this case, the bucket 300 may be twisted at a predetermined angle only when the dovetail protrusion 318 is supported by the dovetail groove 240. That is, the pressure welding of the cover 330 enables the twisted state the blade 320 to persist as long as the first dovetail protrusion 314 remains pressure-welded in the axial direction of the rotor 200 by the first dovetail groove 220 and the second dovetail protrusion 316 remains pressure-welded in the axial direction of the rotor 200 by the second dovetail groove 230.

However, in the related art, if the rotation of the rotating unit exceeds a predetermined speed, the dovetail groove 240 is splayed in the axial direction of the rotor 200 by centrifugal force. Thereby, the pressure welding of the first dovetail protrusion 314 in the axial direction of the rotor 200 by the first dovetail groove 220 is released, and the pressure welding of the second dovetail protrusion 316 in the axial direction of the rotor 200 by the second dovetail groove 230 is released. That is, the twisting of the bucket 300 is released, since the dovetail protrusion 318 is not supported by the dovetail groove 240 and the reaction caused by the twisting of the bucket 300 does not act on the root 310 of the bucket 300. Hence, vibration occurring during operation is increased. In addition, steam leaks between the adjacent covers 330 due to a reduction in contact force between the covers 330.

SUMMARY OF THE INVENTION

An object of the present invention is to provide a rotating unit capable of maintaining the twisting of a bucket even during operation, and a steam turbine including the same.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a rotating unit may include a rotor; a bucket coupled to the rotor to convert fluid energy into mechanical work, the coupled bucket being pre-twisted at a predetermined angle, the bucket having a base surface facing a point of coupling between the rotor and the bucket; and bucket support means, provided at the point of coupling between the rotor and the bucket, for supporting a twisted state of the bucket based on the coupling between the rotor and the bucket.

The bucket support means may include a keyway recessed in the base surface of the bucket, and a key inserted into the keyway.

The bucket may be one of a plurality of buckets, and each bucket may include a root coupled to the rotor and supported by at least one of the rotor and the bucket support means; a blade protruding, in a radial direction of the rotor, from the root to a blade tip of the blade; and a cover protruding, in a rotational direction of the rotor, from the blade tip to a cover of an adjacent bucket of the plurality of buckets, the adjacent covers being pressure-welded to each other to fix the predetermined angle of the twisting of the blade of the bucket.

The root may include a platform formed at a blade root of the blade, and a dovetail protrusion extending toward a center of rotation of the rotor from the platform, and the rotor may include a seating groove in which the platform is seated, and a dovetail groove engaged with the dovetail protrusion of the root. Assuming that the surface facing the center of rotation of the rotor in the second dovetail protrusion is a base surface of the second dovetail protrusion and the surface facing the base surface of the second dovetail protrusion in the second dovetail groove is a base surface of the second dovetail groove, the bucket support means may be formed between the base surface of the second dovetail protrusion and the base surface of the second dovetail groove. In this case, the bucket support means may include a keyway recessed in the base surface of the second dovetail protrusion, and a key inserted into the keyway.

When the rotating unit exceeds a predetermined speed, a pressure welding of the first dovetail protrusion in the axial direction of the rotor by the first dovetail groove may be released, and a pressure welding of the second dovetail protrusion in the axial direction of the rotor by the second dovetail groove may be released, but the second dovetail protrusion remains pressure-welded in the axial direction of the rotor by the bucket support means.

The key may be formed separately from the rotor and the bucket and may be made of a material different from the bucket, which may be a material having higher strength and a higher coefficient of thermal expansion than the bucket.

The keyway and the key may extend in the rotational direction of the rotor. Thus, when the bucket is one of a plurality of buckets, the keyway of one of the plurality of buckets may communicate with a keyway of an adjacent bucket, and the key may have a length in a rotational direction of the rotor that is longer than the keyway such that the key engages with at least two of the plurality of buckets.

The keyway may have a width that is reduced as the keyway approaches the center of rotation of the rotor, and the key may engage with the keyway when inserted.

The bucket support means may further include an auxiliary keyway recessed in the base surface of the bucket, and the key may include a first insertion portion inserted into the keyway and a second insertion portion inserted into the auxiliary keyway while protruding from the first insertion portion. The auxiliary keyway may have a width that is increased as the auxiliary keyway approaches the center of rotation of the rotor, and the second insertion portion of the key may engage with the auxiliary keyway when inserted.

The rotating unit and a steam turbine of the present invention may further provide means to prevent the splaying of the dovetail groove during operation, to more effectively maintain the twisting of the bucket, which is in addition to the bucket support means. Here, the root may include a platform formed at a blade root of the blade, and a dovetail protrusion having a first dovetail protrusion extending to a center of rotation of the rotor from the platform and a second dovetail protrusion surface extending in an axial direction of the rotor from the first dovetail protrusion, the second dovetail protrusion surface forming an acute angle with the first dovetail protrusion, and the rotor may include a seating groove to which the platform is seated, and a dovetail groove having a first dovetail groove engaged with the first dovetail protrusion and a second dovetail groove surface engaged with the second dovetail protrusion surface. In this configuration, a distance between the second dovetail protrusion surface and the center of rotation of the rotor increases with an increasing distance of the second dovetail protrusion surface from the first dovetail protrusion. Also, a rib may protrude from an outer peripheral surface of the rotor and extend in the radial direction of the rotor over a region of the seating groove and the dovetail groove.

In accordance with another aspect of the present invention, a steam turbine may include a casing; the above-described rotating unit rotatably provided in the casing; and a nozzle for injecting steam into the rotating unit.

As is apparent from the above description, the present invention provides a rotating unit and a steam turbine including the same. A rotating unit of a steam turbine includes a rotor; a bucket coupled to the rotor to convert fluid energy into mechanical work, the coupled bucket being pre-twisted at a predetermined angle, the bucket having a base surface facing a point of coupling between the rotor and the bucket; and bucket support means, provided at the point of coupling between the rotor and the bucket, for supporting a twisted state of the bucket based on the coupling between the rotor and the bucket, wherein the bucket support means may include a keyway recessed in the base surface of the bucket, and a key inserted into the keyway, thereby enabling the twisting of the bucket to be maintained during operation. Thus, it is possible to reduce vibration occurring during operation and increase the contact force between a cover formed at the blade tip of the bucket and a cover of another bucket to prevent a leakage of steam between adjacent covers.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view illustrating a portion of a rotating unit in a contemporary steam turbine;

FIG. 2 is a perspective view illustrating a portion of a rotating unit in a steam turbine according to a first embodiment of the present invention;

FIG. 3 is a cross-sectional view taken along line A-A of FIG. 2;

FIG. 4 is a cross-sectional view illustrating a portion of a rotating unit in a steam turbine according to a second embodiment of the present invention;

FIG. 5 is a cross-sectional view illustrating a portion of a rotating unit in a steam turbine according to still a third embodiment of the present invention;

FIG. 6 is a perspective view illustrating a portion of a rotating unit in a steam turbine according to a fourth embodiment of the present invention; and FIG. 7 is a cross-sectional view taken along line B-B of FIG. 6.

DESCRIPTION OF SPECIFIC EMBODIMENTS

Reference will now be made in detail to exemplary embodiments of the present invention, examples of which are illustrated in the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Hereinafter, a rotating unit and a steam turbine including the same according to exemplary embodiments of the present invention will be described in detail with reference to the accompanying drawings.

FIGS. 2 and 3 illustrate a portion of a rotating unit in a steam turbine according to an embodiment of the present invention.

Referring to FIGS. 2 and 3, the steam turbine according to the embodiment of the present invention may include a casing (not shown) that foul's the external appearance and frame thereof, a rotating unit that is rotatably installed in the casing, and a nozzle (not shown) that injects steam into the rotating unit. The rotating unit may include a rotatable rotor 200, which may have a disk shape, and a bucket 300 coupled to the rotor 200 to convert the energy of steam injected from the nozzle into mechanical work. The rotary shaft (not shown) of the rotor 200 passes through the center (not shown) of the rotor 200.

The rotor 200 may have a seating groove 210 and a dovetail groove 240, which are formed in the outer peripheral portion thereof, such that the rotor 200 is coupled with the bucket 300. The coupling is achieved by seating a platform 312 (to be described later) of the bucket 300 in the seating groove 210 and by engaging a dovetail protrusion 318 (to be described later) of the bucket 300 with the dovetail groove 240. Pressure welding (to be described later) completes the coupling.

The seating groove 210 may be recessed from an outer peripheral surface of the rotor 200 toward the center of rotation of the rotor 200 in the radial direction of the rotor 200. The dovetail groove 240 may be further recessed from the seating groove 210 toward the center of rotation of the rotor 200 in the radial direction of the rotor 200. The dovetail groove 240 may include a first dovetail groove 220 that has a shape corresponding to a first dovetail protrusion 314 (to be described later) of the dovetail protrusion 318 and engages with the first dovetail protrusion 314, and a second dovetail groove 230 that has a shape corresponding to a second dovetail protrusion 316 (to be described later) of the dovetail protrusion 318 and engages with the second dovetail protrusion 316.

The seating groove 210 and the dovetail groove 240 may extend in the rotational direction of the rotor 200 such that the bucket 300 is inserted into and is coupled to the rotor 200 in the rotational direction of the rotor 200.

For the sake of convenience, in the following description, the axial direction of the rotor 200 will be referred to as a first direction D1, the rotational direction of the rotor 200 will be referred to as a second direction D2, and the radial direction of the rotor 200 will be referred to as a third direction D3. As the case may warrant, the indicated axial or radial "direction" may be assumed to be either of opposite directions along a corresponding line, and the indicated rotational "direction" may be assumed to be either of opposite rotational directions.

The bucket 300 may consist of a plurality of buckets. In other words, the bucket 300 of the drawings is one of the plurality of buckets 300, which may be arranged adjacent to each other in the second direction D2.

Each of the buckets 300 may include a root 310 coupled to the rotor 200, a blade 320 protruding in the third direction D3 (more precisely, in the centrifugal direction of the rotor 200) from the root 310, and a cover 330 protruding bidirectionally along the second direction D2 from the blade tip of the blade 320. Here, the blade tip forms the end of the blade 320 opposite from the root 310.

The root 310 may include a platform 312 formed at the blade root of the blade 320, and a dovetail protrusion 318 located opposite the blade 320 with respect to the platform 312. Here, the blade root forms the base of the blade 320 opposite from the blade tip.

The first direction length of the platform 312 may be shorter than the first direction length of the rotor such that the platform 312 is inserted into the seating groove 210 of the rotor, the second direction length of the platform may be shorter than the second direction length of the cover 330 such that the cover 330 is pressure-welded to another cover 330 by overlapping therewith, and the third direction length of the platform may be longer than the third direction depth of the seating groove 210 such that the blade 320 protrudes outward of the seating groove 210.

The dovetail protrusion 318 is engageable with the rotor 200, and may have a "T" shape for a reduction in cost of manufacture through shape simplification. That is, the dovetail protrusion 318 may include a first dovetail protrusion 314 that extends toward the center of rotation of the rotor 200 in the third direction D3 from the platform 312, and a second dovetail protrusion 316 that extends bidirectionally along the first direction D1 from the tip of the first dovetail protrusion 314.

The first direction length of the first dovetail protrusion 314 may be shorter than the first direction length of the platform 312, the second direction length of the first dovetail protrusion 314 may be substantially equal to the second direction length of the platform 312, and the third direction length of the first dovetail protrusion 314 may be substantially equal to the third direction length of the platform 312.

The first direction length of the second dovetail protrusion 316 may be longer than the first direction length of the platform 312 and the first direction length of the first dovetail protrusion 314, the second direction length of the second dovetail protrusion 316 may be substantially equal to the second direction length of the platform 312 and the second direction length of the first dovetail protrusion 314, and the third direction length of the second dovetail protrusion 316 may be substantially equal to the third direction length of the platform 312 and the third direction length of the first dovetail protrusion 314.

Meanwhile, the platform 312 and the dovetail protrusion 318 may extend in the second direction D2 such that the bucket 300 is inserted into and coupled to the rotor 200 in the second direction D2.

The blade 320 may have an airfoil profile in which a blade back and a blade belly are located on opposite sides of the blade 320 along the second direction D2.

The cover 330 may be configured such that a cover 330 of a sample bucket 300 of the plurality of buckets 300 is pressure-welded to a cover 330 formed on a bucket 300 adjacent to the sample bucket 300. Each cover 330 is configured to have a second direction length that is longer than a reference length, where the reference length is the length of an arc obtained by dividing the circumference of a circle having a known radius by the number of buckets. Here, the radius of the circle is set as the distance between the rotary shaft of the rotor 200 and the cover 330. Thus, these covers 330 may be pressure-welded to each other by overlapping and tilting when the buckets 300 are coupled to the rotor 200.

Here, the rotating unit may be configured such that the bucket 300 is twisted at a predetermined angle and is then coupled to the rotor 200 to suppress vibration and prevent a leakage of steam. That is, the root 310 of one of the plurality of buckets 300 is supported by the rotor 200 and the cover 330 of the bucket 300 is pressure-welded to the cover 330 of an adjacent bucket 300, thereby enabling the blade 320 of the bucket 300 to be twisted at a predetermined angle.

The bucket 300 may be configured such that, when the root 310 is fixedly supported at the time when the cover 330 is pressure-welded to another cover 330, the blade 320 is twisted. That is, when the first dovetail protrusion 314 is pressure-welded in the first direction D1 by the first dovetail groove 220 and the second dovetail protrusion 316 is pressure-welded in the first direction D1 by the second dovetail groove 230, the blade 320 may be twisted by the pressure welding of the cover 330. The twisting of the bucket can affect the natural frequency of the rotating unit to reduce vibration, and it is possible to enhance the efficiency of the steam turbine by the tight contact between the cover 330 and another cover 330 to prevent a leakage of steam due to the gap therebetween.

However, the twisting of the bucket 300 may be released during operation. That is, the root 310 is well supported by the rotor 200 when the rotational speed of the rotating unit is kept below a predetermined speed, to include a stopped state of the rotating unit, but the root 310 may not be well supported by the rotor 200 when the rotating unit exceeds the predetermined speed such that the dovetail groove 240 is splayed in the first direction D1 by centrifugal force.

In view of this, the rotating unit according to the present embodiment may further include a bucket support means 400 for supporting the bucket 300 at a coupling portion between the rotor 200 and the bucket 300 and for supporting a twisted state of the bucket 300 based on the coupling between the rotor 200 and the bucket 300. The bucket support means 400 may include a keyway 410 recessed in a base surface 316*a* of the second dovetail protrusion 316, and a key 420 inserted into the keyway 410. Thus, the base surface 316*a* is provided to the bucket 300 at the coupling portion and faces a point of coupling between the rotor 200 and the bucket 300.

The bucket support means 400 may be formed, at the coupling portion, between the base surface 316*a* of the second dovetail protrusion 316 of the dovetail protrusion 318 and a base surface 230*a* of the second dovetail groove 230 of the dovetail groove 240, so as to prevent the key 420 from being separated from the keyway 410 by centrifugal force. In this case, the base surface 316*a* of the second dovetail protrusion 316 is a surface facing the center of rotation of the rotor 200, and the base surface 230*a* of the second dovetail groove 230 is a surface facing the base surface 316*a* of the second dovetail protrusion 316.

The bucket support means 400 may be forming at the center of the base surface 316*a* of the second dovetail protrusion 316 of the dovetail protrusion 318 and the center of the base surface 230*a* of the second dovetail groove 230 of the dovetail groove 240 in order to prevent the bucket support means 400 from adversely affecting the rotational balance of the rotating unit.

Meanwhile, according to the present embodiment, the key 420 may be formed separately from the rotor 200 and the bucket 300 to more stably support the bucket 300 and prevent damage to the key 420.

Alternatively, the key 420 may be formed integrally with the rotor 200. That is, a protrusion in the shape of key 420 may be formed to protrude from the base surface 230*a* of the second dovetail groove 230 toward the keyway 410, to reduce manufacturing costs associated with a separate manufacture and assembly of the key 420. However, the integrally formed key 420 may be easily damaged. That is, since the torsional reaction of the bucket 300 and the centrifugal force of the rotating unit are concentrated on a relatively small device, i.e., the key 420 or the above key-shaped protrusion, it is difficult to improve the stiffness of a key 420 formed integrally with the rotor 200.

When, as in the present embodiment, the key 420 is formed separately from the rotor 200 and the bucket 300, the key 420 may be made of a material having higher strength than the rotor 200 and the bucket 300. Therefore, it is possible to prevent damage to the key 420.

In addition, when the key 420 is formed separately from the rotor 200 and the bucket 300, the key 420 may be made of a material having a higher coefficient of thermal expansion than the bucket 300. Thus, since the key 420 is more strongly pressure-welded to the keyway 410 when the rotating unit is thermally expanded by heat generated during operation, it is possible to more stably support the twisting of the bucket 300.

Furthermore, when the key 420 is formed separately from the rotor 200 and the bucket 300, the key 420 may be configured such that the second direction length thereof differs from the second direction length of the keyway 410. That is, the keyway 410 and the key 420 extend in the second direction D2, in which case the keyway 410 formed in one of the plurality of buckets 300 may communicate with a keyway 410 formed in a bucket 300 adjacent to the bucket 300 and the second direction length of the key 420 may be longer than the second direction length of the keyway 410 such that the key 420 is engaged with at least two of the plurality of buckets 300. Thus, a plurality of keyways 410 simultaneously engaged with the same key 420 may be affected by one another through a single key 420, thereby causing the key 420 to provide a stronger reaction to the plurality of buckets 300 supported by the key 420. Therefore, it is possible to more stably support the twisted state of the plurality of buckets 300. Besides, it is possible to prevent the key 420 from rotating relative to the rotor 200 and the bucket 300 when the rotating unit rotates.

The operation and effect of the rotating unit according to the present embodiment and the steam turbine including the same will be described below.

The steam injected from the nozzle may be introduced into the bucket 300 in the first direction D1, and the steam introduced into the bucket 300 may pass through the bucket 300 while the direction of flow of the steam is changed by the bucket 300. In this case, impulsive force may act on the bucket 300 by the steam, so that the bucket 300 may convert the energy of steam into mechanical work while rotating in the second direction D2 together with the rotor 200.

In the rotating unit according to the present embodiment and the steam turbine including the same, since the bucket 300 is twisted at the predetermined angle and then coupled to the rotor 200, the natural frequency of the rotating unit is changed to suppress vibration and prevent a leakage of steam between adjacent covers 330. Therefore, it is possible to enhance energy efficiency.

Since the rotating unit further includes the bucket support means 400, the twisting of the bucket 300 may be maintained even during operation. That is, provided that the rotational speed of the rotating unit does not exceed the predetermined speed, the first dovetail protrusion 314 may be pressure-welded in the first direction D1 by the first dovetail groove 220 and the second dovetail protrusion 316 may be pressure-welded in the first direction D1 by the second dovetail groove 230 and the bucket support means 400. When the rotating unit exceeds the predetermined speed, the dovetail groove 240 is splayed in the first direction D1 so that the pressure welding of the first dovetail protrusion 314 in the first direction D1 by the first dovetail groove 220 is released and the pressure welding of the second dovetail protrusion 316 in the first direction D1 by the second dovetail groove 230 is released. However, the second dovetail protrusion 316 of the dovetail protrusion 318 may still be pressure-welded in the first direction D1 by the bucket support means 400. Thus, it is possible to maintain the torsional reaction acting on the root 310, maintain the contact force between adjacent covers 330, and maintain the twisting of the blade 320. Therefore, it is possible to further suppress vibration occurring during operation, increase the contact force between the adjacent covers 330 to further prevent a leakage of steam through gaps between adjacent covers 330, and further enhance energy efficiency.

Meanwhile, although the keyway 410 and the key 420 have a uniform first direction length (width) in the present embodiment, they may have a variable first direction length as in an embodiment illustrated in FIG. 4. That is, the first direction length of the keyway 410 may be reduced as the keyway 410 approaches the center of rotation of the rotor 200, or as the keyway 410 approaches the base surface 230*a*, in the third direction D3. The key 420 may have a shape corresponding to the shape of the keyway 410 so as to be engaged to the keyway 410. That is, the first direction length of the key 420 may likewise be reduced as the key 420 approaches the center of rotation of the rotor 200, or as the key 420 approaches the base surface 316*a*, in the third direction D3. In this case, the effect of this embodiment may be substantially the same as that of the above embodiment. However, since the opening of the keyway 410 is relatively small in this case, it is possible to previously prevent the separation of the key 420 from the keyway 410 during operation.

Meanwhile, although the key 420 is inserted into only the bucket 300 (more precisely, the keyway 410) in the present embodiment, the key 420 may also be inserted into the rotor 200 as in an embodiment illustrated in FIG. 5. That is, the bucket support means 400 may further include an auxiliary keyway 430 recessed to the center of rotation of the rotor 200 in the third direction D3 from the base surface 230*a* of the second dovetail groove 230. The key 420 may include a first insertion portion 422 that is inserted into the keyway 410, and a second insertion portion 424 that protruding toward the center of rotation of the rotor 200 in the third direction D3 from the first insertion portion 422 and is inserted into the auxiliary keyway 430. Here, the auxiliary keyway 430 and the second insertion portion 424 may extend in the second direction D2. In this case, the effect of this embodiment may be substantially the same as that of the above embodiment. However, in this case, since the bucket 300 is coupled to the rotor 200 and the key 420 in the state in which the position of the key 420 is guided by the auxiliary keyway 430 when the key 420 is assembled to the rotating unit, it is possible to easily assembly the rotating unit. Besides, in this case, since the key 420 is simultaneously supported by the keyway 410 and the auxiliary keyway 430, it is possible to more effectively prevent the key 420 from rotating relative to the rotor 200 and the bucket 300 during operation and to more stably support the bucket 300.

In addition, when the key 420 is simultaneously inserted into the bucket 300 and the rotor 200, the keyway 410 and the first insertion portion 422 of the key 420 may be formed as in the embodiment of FIG. 4 and the auxiliary keyway 430 and the second insertion portion 424 of the key 420 may be formed similarly to the keyway 410 and the first insertion portion 422 of the key 420. Specifically, the first direction length of the keyway 410 may be reduced as the keyway 410 approaches the center of rotation of the rotor 200 in the third direction D3. The first insertion portion 422 of the key 420 may have a shape corresponding to the shape of the keyway 410 so as to engage with the keyway 410. That is, the first direction length of the first insertion portion 422 of the key 420 may be reduced as the first insertion portion 422 approaches the center of rotation of the rotor 200 in the third direction D3.

Meanwhile, as the auxiliary keyway 430 and the second insertion portion 424 are mirror images of the keyway 410 and the first insertion portion 422, the first direction length of the auxiliary keyway 430 may be increased as the auxiliary keyway 430 approaches the center of rotation of the rotor 200 in the third direction D3. Similarly, the second insertion portion 424 of the key 420 may have a shape corresponding to the shape of the auxiliary keyway 430 so as to engage with the auxiliary keyway 430. That is, the first direction length of the second insertion portion 424 of the key 420 may be increased as the second insertion portion 424 approaches the center of rotation of the rotor 200 in the third direction D3. In this case, the effect of this embodiment may be substantially the same as that of the above embodiment. However, since the opening of the auxiliary keyway 430 is relatively small in this case, it is possible to previously prevent the separation of the key 420 from the keyway 410 and the auxiliary keyway 430 during operation. In addition, the movement of the bucket 300 in the third direction D3 is suppressed during operation by the second insertion portion 424 serving to prevent the separation of the key 420 from the auxiliary keyway 430 in the third direction D3, thereby reducing the force of the bucket 300 applied to the dovetail groove 240 of the rotor 200. Thus, it is possible to prevent a phenomenon in which the dovetail groove 240 is splayed. Therefore, it is possible to more securely support the root 310 by the rotor 200 and more stably maintain the twisting of the bucket 300 during operation.

Meanwhile, in addition to the bucket support means 400 supporting root 310 to maintain the twisting of the bucket 300 even when the dovetail groove 240 is splayed by centrifugal force during operation as in the embodiments described above, the rotating unit may also include a dovetail groove splaying prevention means as in an embodiment illustrated in FIGS. 6 and 7. The dovetail groove splaying prevention means prevents the splaying of the dovetail groove 240 during operation, to more effectively maintain the twisting of the bucket 300.

Specifically, the second dovetail protrusion 316 may include a second dovetail protrusion surface 316*b* that forms an acute angle with the first dovetail protrusion 314, and the second dovetail groove 230 may include a second dovetail groove surface 230*b* that forms a complementary angle to engage with the second dovetail protrusion surface 316*b*. In this configuration, the second dovetail protrusion surface 316*b* and the second dovetail groove surface 230*b* overlap in the first direction D1. In more detail, the third direction distance between the second dovetail protrusion surface 316*b* and the center of rotation of the rotor 200 may increase with an increasing distance of the second dovetail protrusion surface 316*b* from the first dovetail protrusion 314 in the first direction D1, and the second dovetail groove surface 230*b* and the second dovetail protrusion surface 316*b* have corresponding and complementary shapes with respect to each other. That is, the third direction distance between the second dovetail groove surface 230*b* and the center of rotation of the rotor 200 may likewise increase with an increasing distance of the second dovetail groove surface 230*b* from the first dovetail protrusion 314 in the first direction D1. In this case, the second dovetail protrusion surface 316*b* prevents the second dovetail groove surface 230*b* from moving away from the bucket 300 in the first direction D1. As a result, it is possible to prevent the splaying of the dovetail groove 220/230 during operation.

In addition, the rotor 200 may have a rib 250 protruding from the outer peripheral surface of the rotor 200, and the rib 250 may extend in the third direction D3 over an outer peripheral portion of the rotor 200 that is structurally adjacent to the region of the seating groove 210 and the dovetail groove 240. Since the rib 250 serves to enhance the stiffness of the outer peripheral portion of the rotor 200 forming the dovetail groove 240, it is possible to prevent the splaying of the dovetail groove 240.

In this case, when the rotating unit rotates at a higher speed than the predetermined speed, the root 310 of the bucket 300 is pressure-welded in the first direction D1 by the rotor 200 as well as the key 420. Therefore, it is possible to more securely support the root 310 and more effectively maintain the twisting of the bucket 300.

While the present invention has been described with respect to the specific embodiments, it will be apparent to those skilled in the art that various changes and modifications may be made without departing from the spirit and scope of the invention as defined in the following claims.

What is claimed is:

1. A rotating unit comprising:

a rotor;

a bucket coupled to the rotor to convert fluid energy into mechanical work, the coupled bucket being pre-twisted at a predetermined angle, the bucket including:

a base surface facing a point of coupling between the rotor and the bucket, and a root coupled to the rotor; and a bucket support provided at the point of coupling between the rotor and the bucket and configured to support a twisted state of the bucket based on the coupling between the rotor and the bucket, wherein the root is supported by at least one of the rotor and the bucket support and comprises:

a platform, and a dovetail protrusion having a first dovetail protrusion extending to a center of rotation of the rotor from the platform and a second dovetail protrusion surface extending in an axial direction of the rotor from the first dovetail protrusion, the second dovetail protrusion surface forming an acute angle with the first dovetail protrusion;

wherein the rotor comprises:

a seating groove to which the platform is seated, a dovetail groove having a first dovetail groove engaged with the first dovetail protrusion and a second dovetail groove surface engaged with the second dovetail protrusion surface, and a rib protruding from an outer peripheral surface of the rotor and extending in the radial direction of the rotor over a region of the seating groove and the dovetail groove.

2. The rotating unit according to claim 1, wherein the bucket support comprises a keyway recessed in the base surface of the bucket, and a key inserted into the keyway.

3. The rotating unit according to claim 1, wherein the bucket is one of a plurality of buckets, each bucket comprising:

a blade protruding, in a radial direction of the rotor, from the root to a blade tip of the blade; and a cover protruding, in a rotational direction of the rotor, from the blade tip to a cover of an adjacent bucket of the plurality of buckets, the adjacent covers being pressure-welded to each other to fix the predetermined angle of the twisting of the blade of the bucket.

4. The rotating unit according to claim 1, wherein the dovetail protrusion of the root includes the first dovetail protrusion and a second dovetail protrusion, and the dovetail groove of the rotor includes the first dovetail groove and a second dovetail groove, wherein the second dovetail protrusion has a base surface facing the center of rotation of the rotor, and the second dovetail groove has a base surface facing the base surface of the second dovetail protrusion, and wherein the bucket support is formed between the base surface of the second dovetail protrusion and the base surface of the second dovetail groove.

5. The rotating unit according to claim 4, wherein the bucket support comprises a keyway recessed in the base surface of the second dovetail protrusion, and a key inserted into the keyway.

6. The rotating unit according to claim 4, wherein when the rotating unit exceeds a predetermined speed, a pressure welding of the first dovetail protrusion in the axial direction of the rotor by the first dovetail groove is released, a pressure welding of the second dovetail protrusion in the axial direction of the rotor by the second dovetail groove is released, and the second dovetail protrusion remains pressure-welded in the axial direction of the rotor by the bucket support.

7. The rotating unit according to claim 2, wherein the key is formed separately from the rotor and the bucket.

8. The rotating unit according to claim 7, wherein the key is made of a material different from the bucket.

9. The rotating unit according to claim 8, wherein the material of the key has higher strength and a higher coefficient of thermal expansion than the bucket.

10. The rotating unit according to claim 7, wherein the keyway and the key extend in the rotational direction of the rotor.

11. The rotating unit according to claim 10, wherein the bucket is one of a plurality of buckets, the keyway of one of the plurality of buckets communicates with a keyway of an adjacent bucket, and the key has a length in a rotational direction of the rotor that is longer than the keyway such that the key engages with at least two of the plurality of buckets.

12. The rotating unit according to claim 2, wherein the keyway has a width that is reduced as the keyway approaches the center of rotation of the rotor, and the key engages with the keyway when inserted.

13. The rotating unit according to claim 2, wherein the bucket support further comprises an auxiliary keyway recessed in a base surface of the rotor, and wherein the key comprises a first insertion portion inserted into the keyway, and a second insertion portion inserted into the auxiliary keyway while protruding from the first insertion portion.

14. The rotating unit according to claim 13, wherein the auxiliary keyway has a width that is increased as the auxiliary keyway approaches the center of rotation of the rotor, and the second insertion portion of the key engages with the auxiliary keyway when inserted.

15. The rotating unit according to claim 1, wherein the second dovetail protrusion surface and the second dovetail groove surface are formed such that a distance between the second dovetail protrusion surface and the center of rotation of the rotor increases with an increasing distance of the second dovetail protrusion surface from the first dovetail protrusion.

16. A steam turbine comprising:

a casing;

the rotating unit, according to claim 1, rotatably provided in the casing; and a nozzle for injecting steam into the rotating unit.

17. A steam turbine comprising:

a casing;

a rotating unit rotatably provided in the casing; and a nozzle for injecting steam into the rotating unit, wherein the rotating unit comprises:

a rotatable rotor, and a plurality of buckets coupled to the rotor to convert energy of steam injected from the nozzle into mechanical work;

wherein each of the buckets comprises:

a root coupled to the rotor, a blade protruding in a radial direction of the rotor from the root, and a cover protruding in a rotational direction of the rotor from a blade tip of the blade;

wherein the root comprises:

a platform formed at a blade root of the blade, and a dovetail protrusion having a first dovetail protrusion extending to a center of rotation of the rotor from the platform and a first dovetail protrusion including a second dovetail protrusion surface extending in an axial direction of the rotor from the first dovetail protrusion, the second dovetail protrusion surface forming an acute angle with the first dovetail protrusion;

wherein the rotor comprises:

a seating groove to which the platform is seated, a dovetail groove having a first dovetail groove engaged with the first dovetail protrusion and a second dovetail groove including a second dovetail groove surface engaged with the second dovetail protrusion surface, and a rib protruding from an outer peripheral surface of the rotor and extending in the radial direction of the rotor over a region of the seating groove and the dovetail groove; and wherein the second dovetail protrusion surface and the second dovetail groove surface are formed such that a distance between the second dovetail protrusion surface and the center of rotation of the rotor increases with an increasing distance of the second dovetail protrusion surface from the first dovetail protrusion.

18. A steam turbine comprising:

a casing;

a rotating unit rotatably provided in the casing; and a nozzle for injecting steam into the rotating unit, wherein the rotating unit comprises:

a rotatable rotor, and a plurality of buckets coupled to the rotor to convert energy of steam injected from the nozzle into mechanical work;

wherein each of the buckets comprises:

a root coupled to the rotor, a blade protruding in a radial direction of the rotor from the root, and a cover protruding in a rotational direction of the rotor from a blade tip of the blade;

wherein the root comprises:

a platform formed at a blade root of the blade, and a dovetail protrusion having a first dovetail protrusion extending to a center of rotation of the rotor from the platform and a second dovetail protrusion extending in an axial direction of the rotor from the first dovetail protrusion; and wherein the rotor comprises:

a seating groove to which the platform is seated, a dovetail groove having a first dovetail groove engaged with the first dovetail protrusion and a second dovetail groove engaged with the second dovetail protrusion, and a rib protruding from an outer peripheral surface of the rotor and extending in the radial direction of the rotor over a region of the seating groove and the dovetail groove.

* * * * *